US011125497B2

(12) United States Patent
Butts

(10) Patent No.: US 11,125,497 B2
(45) Date of Patent: Sep. 21, 2021

(54) SYSTEM AND METHOD FOR SEPARATING NATURAL GAS LIQUID AND NITROGEN FROM NATURAL GAS STREAMS

(71) Applicant: BCCK Holding Company, Midland, TX (US)

(72) Inventor: Rayburn C. Butts, Midland, TX (US)

(73) Assignee: BCCK Holding Company, Midland, TX (US)

( * ) Notice: Subject to any disclaimer, the term of this patent is extended or adjusted under 35 U.S.C. 154(b) by 0 days.

(21) Appl. No.: 16/677,378

(22) Filed: Nov. 7, 2019

(65) Prior Publication Data

US 2020/0072547 A1 Mar. 5, 2020

Related U.S. Application Data

(63) Continuation of application No. 15/433,375, filed on Feb. 15, 2017, now Pat. No. 10,520,250.

(51) Int. Cl.
*F25J 5/00* (2006.01)
*F25J 3/02* (2006.01)

(52) U.S. Cl.
CPC ..... *F25J 3/0257* (2013.01); *F25J 3/0233* (2013.01); *F25J 3/0238* (2013.01); *F25J 3/0295* (2013.01);
(Continued)

(58) Field of Classification Search
CPC ..... F25J 3/0257; F25J 3/0233; F25J 3/0238; F25J 3/0295; F25J 5/005; F25J 2200/08; F25J 2200/04; F25J 2200/78
See application file for complete search history.

(56) References Cited

U.S. PATENT DOCUMENTS 2,442,474 A 6/1948 Scarth
4,323,380 A 4/1982 Muller et al.
(Continued)

FOREIGN PATENT DOCUMENTS

CN 103827063 5/2014
DE 2932561 1/1981
(Continued)

OTHER PUBLICATIONS

Looney, Sherry K. et al., NRU is Onstream Successfully at Block 31, Oil & Gas Journal, Pennwell, Houston, TX US, vol. 82, Jan. 1, 1984, pp. 103-108, XP009166787, ISSN 0030-1388.

*Primary Examiner* — Elizabeth J Martin
*Assistant Examiner* — Nael N Babaa
(74) *Attorney, Agent, or Firm* — Scheef & Stone, LLP; Robin L. Barnes

(57) ABSTRACT

A system and method for removing nitrogen and producing a high pressure methane product stream and an NGL product stream from natural gas feed streams where at least 90%, and preferably at least 95%, of the ethane in the feed stream is recovered in the NGL product stream. The system and method of the invention are particularly suitable for use with feed streams in excess of 5 MMSCFD and up to 300 MMSCFD and containing around 5% to 80% nitrogen. The system and method preferably combine use of strategic heat exchange between various process streams with a high pressure rectifier tower and the ability to divert all or a portion of a nitrogen rejection unit feed stream to optionally bypass a nitrogen fractionation column to reduce capital costs and operating expenses.

20 Claims, 5 Drawing Sheets

(52) U.S. Cl.
CPC ..... *F25J 5/005* (2013.01); *F25J 2200/08* (2013.01); *F25J 2200/40* (2013.01); *F25J 2200/78* (2013.01); *F25J 2200/92* (2013.01); *F25J 2200/94* (2013.01); *F25J 2205/04* (2013.01); *F25J 2210/06* (2013.01); *F25J 2210/42* (2013.01); *F25J 2210/60* (2013.01); *F25J 2215/04* (2013.01); *F25J 2230/20* (2013.01); *F25J 2230/60* (2013.01); *F25J 2240/02* (2013.01); *F25J 2240/44* (2013.01); *F25J 2245/02* (2013.01); *F25J 2250/04* (2013.01); *F25J 2270/90* (2013.01); *F25J 2280/02* (2013.01); *F25J 2290/12* (2013.01); *F25J 2290/34* (2013.01)

(56) References Cited

U.S. PATENT DOCUMENTS

| | | | | |
|---|---|---|---|---|
| 4,331,461 | A * | 5/1982 | Karbosky | C07C 7/00 62/630 |
| 4,411,677 | A | 10/1983 | Pervier et al. | |
| 4,451,275 | A | 5/1984 | Vines et al. | |
| 4,474,591 | A | 10/1984 | Arand et al. | |
| 4,504,295 | A | 3/1985 | Davis et al. | |
| 4,547,209 | A | 10/1985 | Netzer | |
| 4,609,390 | A | 9/1986 | Wilson | |
| 4,664,686 | A | 5/1987 | Pahade et al. | |
| 4,746,342 | A | 5/1988 | DeLong et al. | |
| 4,758,258 | A | 7/1988 | Mitchell et al. | |
| 4,948,405 | A | 8/1990 | Thompson | |
| 5,041,149 | A | 8/1991 | Handley | |
| 5,051,120 | A | 9/1991 | Pahade et al. | |
| 5,141,544 | A | 8/1992 | Butts | |
| 5,257,505 | A | 11/1993 | Butts | |
| 5,375,422 | A | 12/1994 | Butts | |
| 6,116,051 | A | 9/2000 | Agrawal et al. | |
| 6,205,813 | B1 | 3/2001 | Shah et al. | |
| 6,401,486 | B1 | 6/2002 | Lee et al. | |
| 6,758,060 | B2 | 7/2004 | O'Brien | |
| 7,257,966 | B2 | 8/2007 | Lee et al. | |
| 7,520,143 | B2 | 4/2009 | Spilsbury | |
| 7,793,517 | B2 | 9/2010 | Patel et al. | |
| 7,818,979 | B2 | 10/2010 | Patel et al. | |
| 7,856,847 | B2 | 12/2010 | Patel et al. | |
| 8,522,574 | B2 | 9/2013 | Crawford et al. | |
| 8,640,495 | B2 | 2/2014 | McNeil | |
| 9,003,829 | B2 | 4/2015 | Bauer et al. | |
| 2003/0177786 | A1 * | 9/2003 | O'Brien | F25J 3/0242 62/620 |
| 2004/0237581 | A1 | 12/2004 | Paradowski | |
| 2006/0150672 | A1 | 7/2006 | Lee et al. | |
| 2007/0157663 | A1 | 7/2007 | Mak et al. | |
| 2009/0100862 | A1 | 4/2009 | Wilkinson et al. | |
| 2011/0023536 | A1 * | 2/2011 | Jager | F25J 1/0219 62/611 |
| 2011/0174017 | A1 | 7/2011 | Victory et al. | |
| 2011/0277500 | A1 | 11/2011 | Bauer et al. | |
| 2012/0324943 | A1 | 12/2012 | Butts | |
| 2014/0013797 | A1 | 1/2014 | Butts | |
| 2014/0182331 | A1 | 7/2014 | Burmberger et al. | |
| 2014/0303422 | A1 | 10/2014 | Das et al. | |
| 2017/0051970 | A1 * | 2/2017 | Mak | F25J 3/0209 |
| 2018/0149424 | A1 | 5/2018 | Oelfke et al. | |

FOREIGN PATENT DOCUMENTS

| | | |
|---|---|---|
| EP | 2656898 | 10/2013 |
| GB | 2208699 | 4/1989 |
| WO | WO2002079706 | 10/2002 |
| WO | WO2009144423 | 3/2009 |
| WO | WO2010109228 | 9/2010 |
| WO | WO2012087740 | 6/2012 |
| WO | WO2017144151 | 8/2017 |

* cited by examiner

SYSTEM AND METHOD FOR SEPARATING NATURAL GAS LIQUID AND NITROGEN FROM NATURAL GAS STREAMS

CROSS-REFERENCE TO RELATED APPLICATION

This application is a continuation of U.S. application Ser. No. 15/433,375 filed on Feb. 15, 2017, now U.S. Pat. No. 10,520,250 issued on Dec. 31, 2019.

BACKGROUND OF THE INVENTION

1. Field of the Invention

This invention relates to a system and method for separation of natural gas liquid (NGL) components and nitrogen from raw natural gas streams. The system and method are particularly suitable for applications where there may be a wide range of inlet nitrogen concentrations and where a high efficiency in NGL extraction is desired. The system and method are also particularly suitable for use with inlet gas stream volumes from 5 million cubic feet per day (MMSCFD) up to 300 MMSCFD and having nitrogen concentrations of 5 to 80% and with NGL content from 0 to 8 gallons (ethane plus) per 1000 MSCFD of inlet gas.

2. Description of Related Art

Natural gas as produced in several areas around the world contains impurities that make the natural gas stream unmarketable without processing to remove at least some of these impurities. Typically, these gas streams may contain excessive amounts of water, $H_2S$, $CO_2$, Natural Gas Liquids (commonly referred to as NGLs, which typically comprises ethane, propane, butanes, pentanes, and other natural gasoline components), and nitrogen (which may be naturally occurring or may have been injected into the reservoir as part of an enhanced recovery operation). There are many known methods for removing $H_2S$ and $CO_2$, including use of chemical or physical solvents. There are also known methods for removing water from the natural gas stream, including using a glycol based absorbent or by molecular sieve methods. Natural gas as transmitted through commercial pipelines in the United States and other places around the world must meet pipeline specifications on contaminants, containing only limited amounts of NGL components and nitrogen to meet standards for commercial natural gas. Transporting pipelines typically do not accept natural gas containing more than 4 mole percent inerts, such as nitrogen. The standard prior art industry approach to processing natural gas to remove impurities to meet pipeline specifications is as follows: (1) remove the $H_2S$ and $CO_2$ impurities; (2) remove excessive amounts of water vapor; (3) remove NGL components (which may be recovered and sold as an NGL product stream); (4) recompress the gas stream downstream of NGL removal and upstream of nitrogen removal; (5) remove the nitrogen component. Typical prior art systems extract NGL components (step 3) by utilizing expander technology to reduce the inlet pressure from approximately 800 psig down to a pressure level of near 300 psig upstream of the nitrogen removal/rejection process. Most prior art nitrogen rejection systems require a pressure of around 500 psig or higher to operate efficiently. Because the gas feeding into the NRU process from the NGL process is only a pressure of around 300 psig, it must be recompressed (step 4) prior to feeding into a nitrogen removal column. Additionally, a sales gas stream containing higher amounts of one or more impurities, such as nitrogen, may be mixed/blended or diluted with other sales gas streams containing less impurities to achieve the desired nitrogen specification.

There are also several known methods of nitrogen removal, such as a nitrogen rejection unit or NRU comprised of two cryogenic fractionating columns, as described in U.S. Pat. Nos. 4,451,275 and 4,609,390, or comprised of a single fractionating column, as described in U.S. Pat. Nos. 5,141,544, 5,257,505, and 5,375,422. However, dilution and full-blown NRU installation and operation are expensive for the gas processor. Additionally, a complete stand-alone NRU, which is capable of removing large percentages of nitrogen, may not be necessary or economically feasible where the sales gas exceeds the nitrogen specification by only a small amount.

As disclosed in U.S. Patent Application Publication No. 2014/0013797, it is also known to integrate nitrogen removal into a conventional gas subcooled expander process (GSP) to efficiently remove excess nitrogen to acceptable levels without any significant negative impact on NGL recovery. The nitrogen removal unit may be integrated into the GSP system upstream of the demethanizer column that produces the NGL product stream, so that the NRU bottom stream feeds the demethanizer column (rather than the overhead stream from the demethanizer column feeding the NRU as in typically prior art systems). This integrated system is less costly than operating an NRU independently of the GSP process and recovers around 87% of the inlet stream ethane in the NGL product stream. However, there is still a need to compress the gas stream in the NRU processing section prior to feeding into the demethanizer column, which adds to the capital costs and operating costs of the integrated system. Although an improvement over the standard prior art process, there is still a need for greater improvement in capital costs and operating costs of the integrated system and in ethane recovery in the NGL product stream.

SUMMARY OF THE INVENTION

The system and method disclosed herein facilitate the economically efficient removal of nitrogen from methane and improved recovery of NGL components in an NGL product stream from incoming gas streams, over a wide range of gas compositions, by utilizing an integrated approach to maximize the removal efficiency with reduced installation cost. According to one preferred embodiment of the invention, the system and method modify the five step standard prior art industry approach to processing natural gas described above by integrating heat transfer and process streams between steps 3 (removal of NGL components in an NGL processing section of the system and method) and 5 (removal of nitrogen component in an NRU processing section of the system and method) in a way that allows elimination of step 4 (recompression downstream of NGL removal and upstream of nitrogen removal). Typical prior art systems extract NGL components by utilizing expander technology to reduce the inlet pressure from approximately 800 psig down to a pressure level of near 300 psig upstream of the nitrogen removal/rejection process. This then requires the gas to be recompressed prior to feeding the nitrogen removal process to reach the 500 psig pressure needed for efficient operation of the prior art systems. However, this compression is eliminated according to a preferred embodiment of the invention because the streams exiting the NGL processing section (from the first and second fractionating columns) that feed into the NRU processing section (nitrogen removal fractionation column) are at sufficiently high pressure without compression. The integration of these two sections reduces the equipment count compared to standard prior art systems by approximately one third and the cost ranging between 25 to 50%.

According to another preferred embodiment, the first fractionating column is an engineered fractionation device referred to as a High Pressure Rectifier and is used in combination with a small compressor (most preferably part of an expander/compressor unit where the compressor is driven by energy extracted from the expander unit) embedded within the NGL extraction section. The compressor compresses a portion of the overhead stream from the High Pressure Rectifier Tower (from a pressure of around 500 psia to around 600 psia according to one example of a preferred embodiment). The High Pressure Rectifier is a modified fractionation tower with an internal reflux condenser and operates without the normal reboiler equipment. This High Pressure Rectifier Tower operates at pressures of around 500 psia, unlike prior art systems operating around 265 psia, that when added to the relatively small pressure boost produced by the expander/compressor, the resulting pressure is adequate to enter the nitrogen extraction section without further compression as required in prior art systems. It should be noted the compressor portion of the expander/compressor combination used as part of the NGL extraction section according to this preferred embodiment of the invention to compress a relatively small volumetric flow to increase the pressure by around 100 psi, should not be mistaken for the same compressor requirements used to increase the pressure of the inlet feed to the NRU section as in prior art systems, which requires greater capital and operating costs to compress a larger volumetric flow by almost 200 psi. It similarly should not be mistaken for the compression requirements for compressing a portion of the NRU bottom stream prior to feeding the demethanizer column as disclosed in U.S. Patent Application Publication No. 2014/0013797, which also requires greater capital and operating costs to compress a larger volumetric flow by almost 200 psi. The strategic placement of the High Pressure Rectifier tower and the compressor end of the expander are important to the successful operation of the two integrated sections of this embodiment of the system. In this preferred embodiment, the High Pressure Rectifier Tower and the NGL Stabilizer Tower are separate towers allowing for the two towers to operate at different pressures when compared to the typical demethanizer tower used in prior art systems and methods. This allows the pressure of the overhead stream from the High Pressure Rectifier that feeds into the nitrogen removal fractionation column to be around 500 psig, which is sufficiently high for efficient operation of the nitrogen removal fractionation column according to this embodiment of the invention. Without the high pressure rectifier, the pressure leaving a standard expander plant would be approximately 350 psig. With conventional technology for NGL extraction, it is necessary to add intermediate compression between the NGL section and the NRU section.

According to another preferred embodiment of the invention, at least a portion of the inlet gas feed stream supplies heat to a bottom reboiler of a second fractionation column. According to another preferred embodiment, at least a portion of the inlet gas feed stream supplies heat to a sidetray reboiler for the second fractionation column. According to another preferred embodiment of the invention, when the inlet gas feed stream exceeds 2 gallons of NGLs per inlet MSCF or GPM, an auxiliary refrigerant stream or chiller is used to reduce the temperature of at least a portion of the incoming gas feed stream (from around 50° to −30° Fahrenheit according to one example of a preferred embodiment) prior to feeding into a first separation step. Most preferably, this cooling is downstream of the bottom reboiler and upstream of the sidetray reboiler of the second fractionation column. This cooling is beneficial because it improves the NGL extraction efficiency.

According to another preferred embodiment of the invention, a cooled, methane product stream is recycled back into the system to assist in reducing the temperature of at least another portion of the incoming gas feed stream prior to feeding the first separator (from a temperature of around +120° to near −50° Fahrenheit according to one example of a preferred embodiment). According to yet another preferred embodiment of the invention, at least another portion of the inlet gas feed stream is cooled through heat exchange with at least a portion of an overhead stream from the first fractionating column prior to feeding the first separator. These cooling steps prior to feeding the first separator are beneficial because they allow for a colder feed to the NGL Stabilizer Tower which increases the amount of NGL liquids separated from the feed stream.

According to another preferred embodiment, a portion of the recycled methane stream and at least a portion of a bottoms stream from a nitrogen removal fractionation column are used to supply refrigerant to a heat exchanger to cool a bottoms stream of the first fractionating column prior to feeding the second fractionating column (which produces the NGL product stream). According to another preferred embodiment, another portion of the recycled methane stream and another portion of a bottoms stream from the nitrogen removal fractionation column are used to supply refrigerant to an internal reflux heat exchanger in the first fractionating column.

According to another preferred embodiment of the invention, an expander is used to expand the overhead stream from the first separation step to effectively extract work from the inlet feed gas as the inlet feed gas pressure is reduced from the pressure entering the first separator to the overhead stream of the first separator (a reduction from approximately 800 psig to around 500 psig according to one example of a preferred embodiment), thereby reducing the temperature of the affected gas stream (from around −73° to around −105° Fahrenheit according to one example of a preferred embodiment. This temperature and pressure reduction is beneficial because it provides the cooling necessary to begin the process of dropping out natural gas liquids (NGLs) from the inlet gas stream.

According to another preferred embodiment of the invention, a portion of the overhead stream from the first separation step supplies heat to a reboiler for the nitrogen removal fractionation column prior to feeding the first fractionation column. Most preferably, this occurs downstream of the expansion step. According to another preferred embodiment, at least a portion of the overhead stream from the first fractionating column is cooled (to around −300° F. according to one example of a preferred embodiment) in a subcooler through heat exchange with the overhead stream from the nitrogen removal fractionation column prior to feeding the nitrogen removal fractionation column.

According to another preferred embodiment of the invention, a portion of the inlet gas feed stream (upstream of feeding the first separator), a portion of the overhead stream of the first fractionating column (upstream of feeding the nitrogen removal fractionation column), and a recycled portion of the methane product stream are cooled through heat exchange with the bottoms and overhead streams of the nitrogen removal fractionation column and the recycled portion of the methane product stream in a first heat exchanger. According to yet another preferred embodiment, cooled portion of the overhead stream of the first fractionating column (downstream of the first heat exchanger, but upstream of feeding the nitrogen removal fractionation column) and the recycled portion of the methane product stream (downstream of the first heat exchanger) are further cooled through heat exchange with the bottoms and overhead streams of the nitrogen removal fractionation column and the recycled portion of the methane product stream in a second heat exchanger.

According to another preferred embodiment, a portion of the overhead stream of the first fractionating column is one feed stream into the nitrogen removal fractionation column and a second portion of the overhead stream from the first fractionating column is combined with the overhead stream from the second fractionating column to form a second feed stream into the nitrogen removal fractionation column.

According to another preferred embodiment, at least a portion of the inlet gas stream is processed through the NGL processing section (a separator and two fractionating columns), but can optionally bypass the NRU processing section. Most preferably, this is achieved by being able to divert all or a portion of the second NRU feed stream to mix with a sales gas stream (a portion of the bottoms stream from the nitrogen removal fractionation column) rather than feeding into the nitrogen removal fractionation column. When the nitrogen content of the inlet gas stream is low enough, this allows the option of fully processing only part of the inlet feed gas for nitrogen removal so that the treated and untreated portions can be blended to meet pipeline specifications for nitrogen content. Most preferably, the treated portion has nitrogen removed in the NRU section to a 1% level, which may then be blended with the bypassed gas coming from the NGL removal section, in such a ratio to meet the desired pipeline specification for permissible nitrogen content. This provides a reduction in sales gas compressor horsepower cost and a significant improvement in the overall system performance.

According to another preferred embodiment, four strategically placed control valves applying the Joule-Thomson Effect and referred to as (JT) valves are used to provide cooling throughout the system and substantial cooling between the feed stream temperature and temperatures of streams feeding and exiting the nitrogen removal fractionation column (from approximately +120° in the inlet feed down to a temperature range of approximately −300° Fahrenheit in the NRU Processing Section according to one example of a preferred embodiment of the invention).

Systems and methods according to preferred embodiments of the invention allow for efficient removal of nitrogen and improved recovery of NGL components, while saving on capital costs and operating costs. Preferably, the systems and methods are capable of recovering at least 90%, and more preferably at least 95%, of the ethane and almost 100% of the propane and heavier component from the feed stream in the NGL product stream. The systems and methods are also preferably capable of achieving 99% purity in the vented nitrogen stream, with the remaining 1% balance preferably consisting of methane only and so that no heavy hydrocarbons (defined as ethane and heavier components) are vented, and a processed sales gas stream from the nitrogen removal fractionation tower containing less than 4% nitrogen, with the capability of being reduced to 1% if required.

BRIEF DESCRIPTION OF THE DRAWINGS

The system and method of the invention are further described and explained in relation to the following drawings wherein.

DESCRIPTION OF THE PREFERRED EMBODIMENTS

Figure 1:
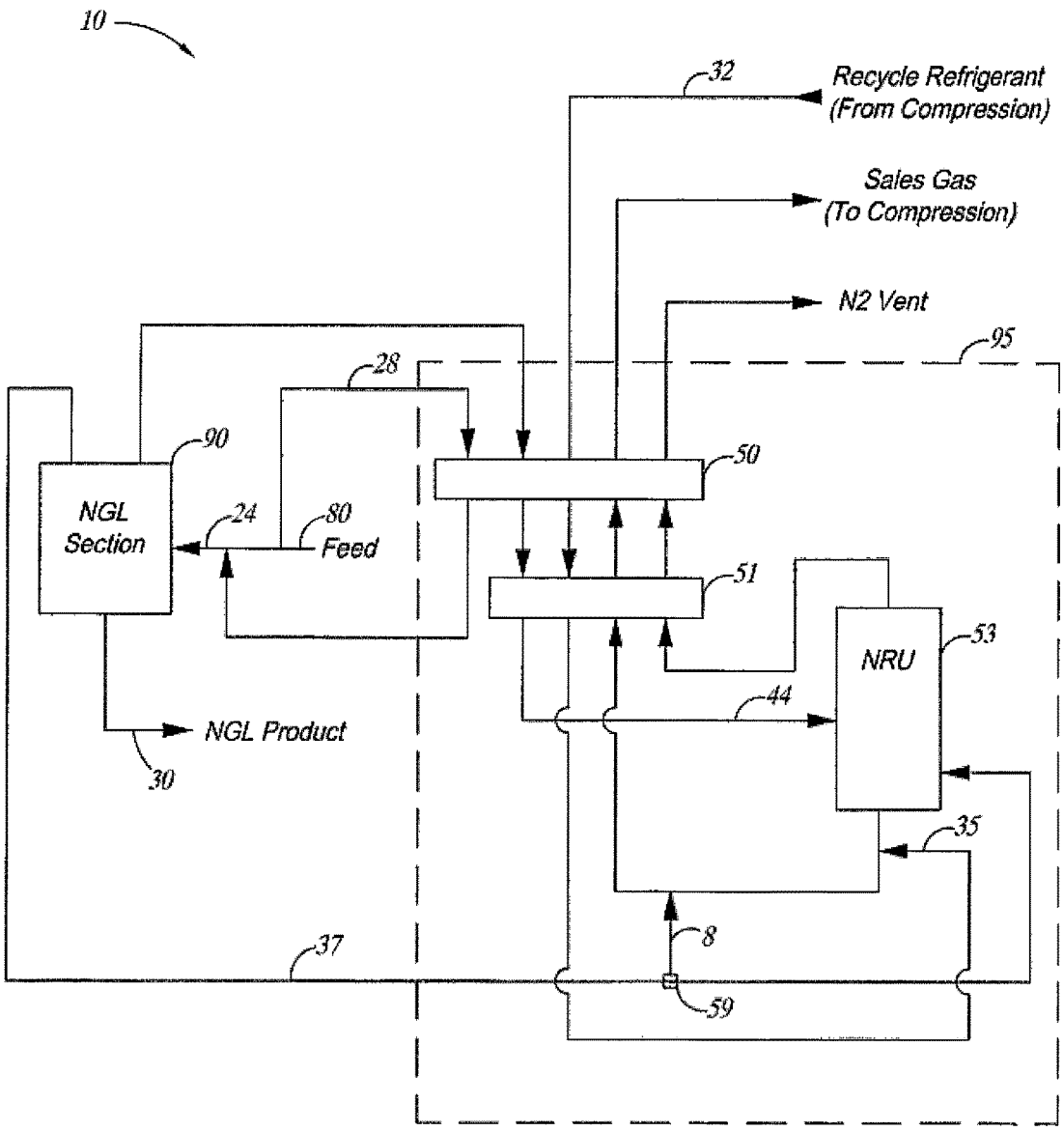
FIG. 1 is a simplified process flow diagram illustrating principal processing stages for removing nitrogen and producing an NGL product stream and sales gas stream according to a preferred embodiment of the invention.
Figure 2:
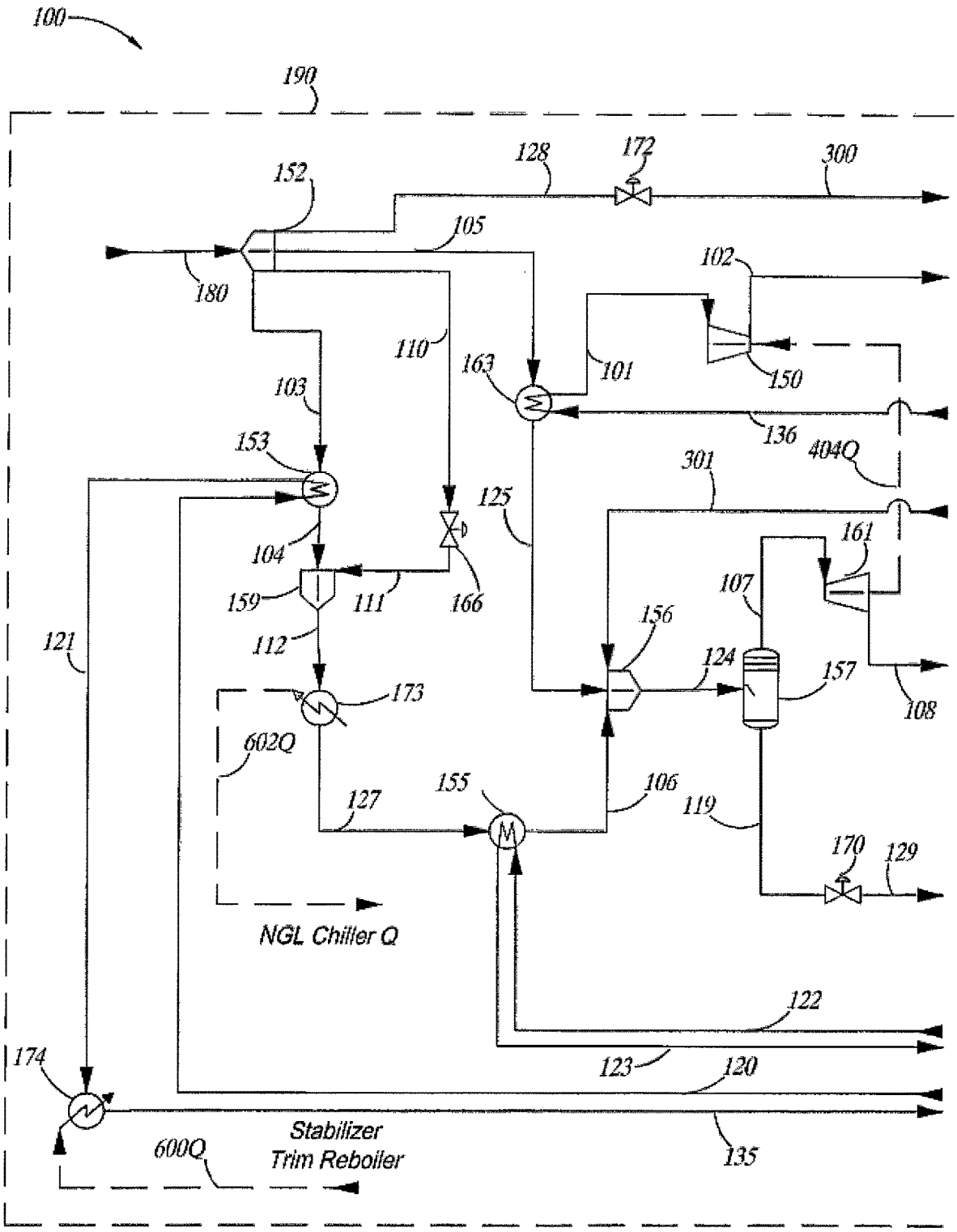
FIG. 2 is a process flow diagram illustrating principal processing stages for part of an NGL processing section according to another preferred embodiment of the invention.

Referring to FIG. 1, a preferred embodiment of system 10 is depicted. System 10 preferably comprises an NGL Section 90 and an NRU section 95. Feed stream 80, comprising raw natural gas (having already been processed according to known methods to remove excessive amounts of $H_2S$, $CO_2$, and water) is preferably split, with a portion (stream 28) passing through heat exchanger 50 and then being remixed with the remainder of feed stream 80 before feeding into NGL processing section 90 as stream 24 where it is separated into an NGL product stream 30 and NRU feed streams 44 and 37. NRU feed stream 44 passes through heat exchangers 50 and 51 prior to feeding an NRU Fractionating Tower 53.

NRU feed streams 44 and 37 are separated in NRU Fractionating Tower 53 into a nitrogen vent stream and a sales gas stream. The nitrogen vent stream and sales gas stream both pass through heat exchangers 50 and 51. The sales gas stream then proceeds to a compression processing section (not shown, but similar to FIG. 7 in U.S. Application Publication No. 2012/0324946, incorporated herein by reference), where it is compressed to a desired pipeline pressure specification. A recycle refrigerant stream 32 is returned from the compression processing section and also passes through heat exchangers 50 and 51. A splitter 59 allows for reducing (or eliminating) feed stream 37 into NRU 53. All or a portion of this stream may be diverted to stream 8 to bypass NRU 53. Stream 8 is mixed with the sales gas stream if the nitrogen content is low enough to allow blending to meet pipeline specifications without removing nitrogen in NRU 53. This bypass/reduction option allows for significant operational savings in the operation of NRU 53 when the nitrogen content of feed gas stream 80 and other operational parameters allow for such. System 10 is capable of processing up to 300 Million Standard Cubic Feet per Day (MMSCFD) of feed gas containing up to 80% $N_2$ to produce a sales gas stream that meets pipeline specifications on $N_2$ concentration and to recover at least 90% of the ethane, and more preferably at least 95% of the ethane, from the feed stream in the NGL product stream.

Figure 3:
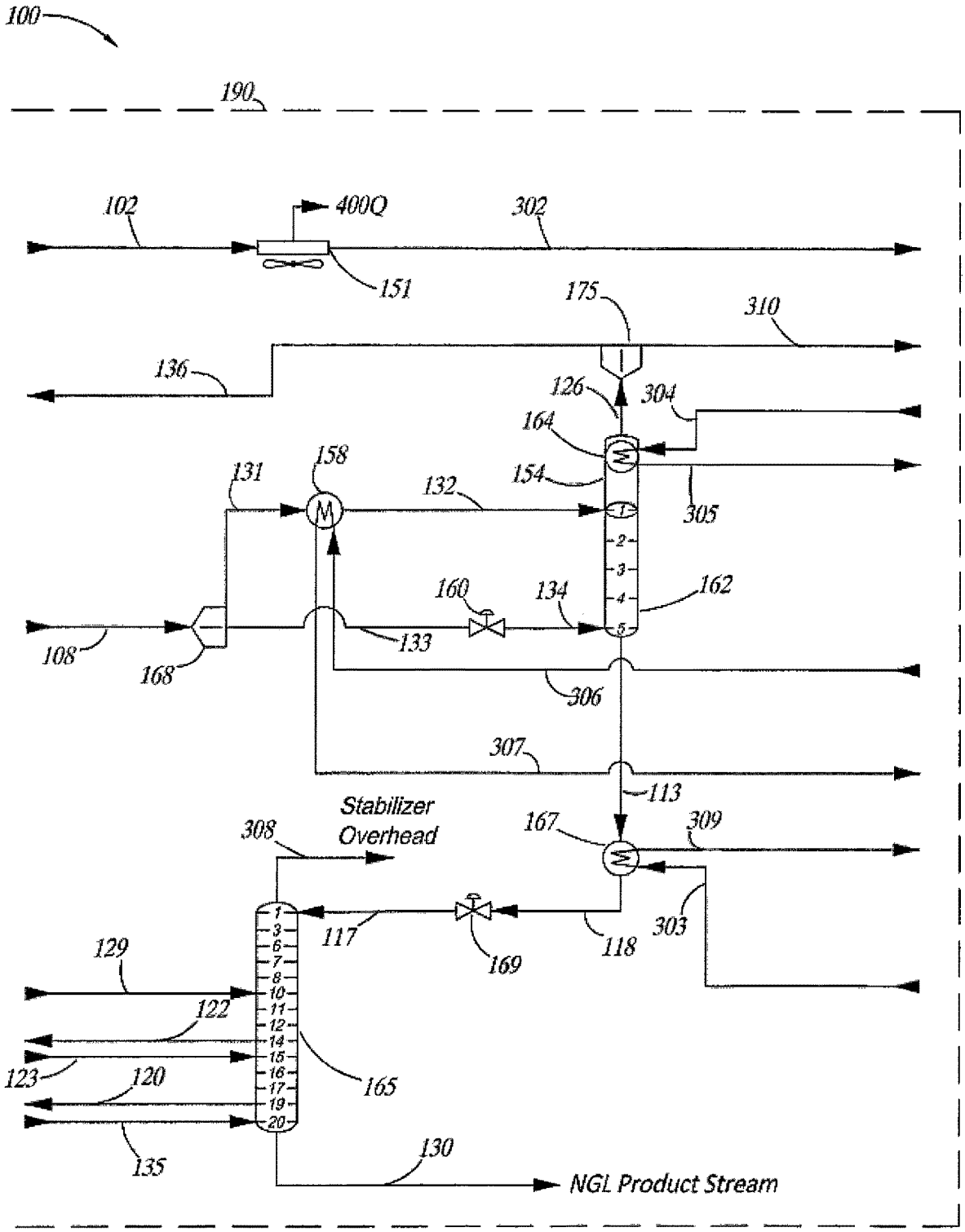
FIG. 3 is a process flow diagram illustrating principal processing stages for another part of an NGL processing section according to a preferred embodiment of the invention.
Figure 4:
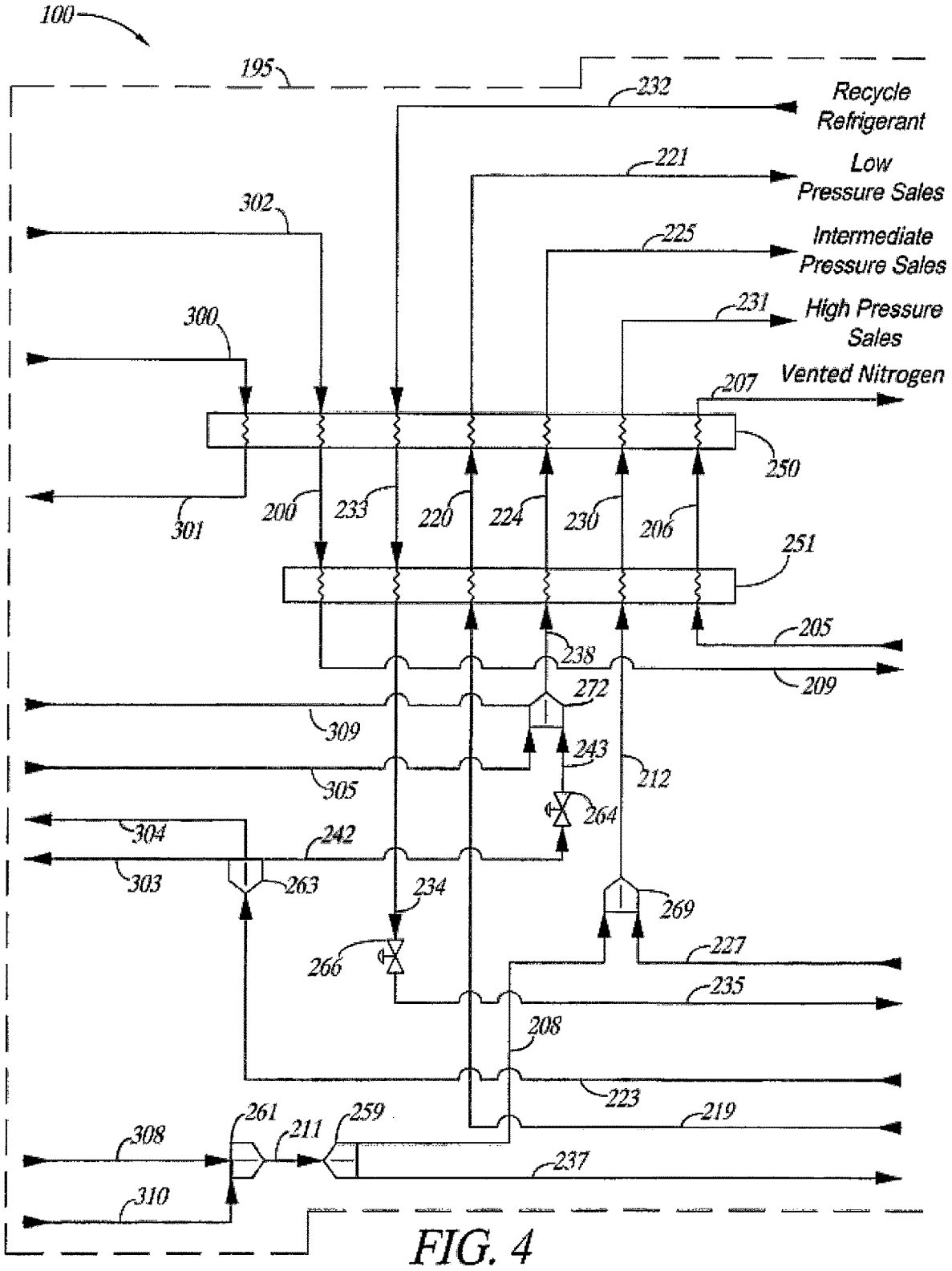
FIG. 4 is a process flow diagram illustrating principal processing stages for a part of a nitrogen removal processing section according to a preferred embodiment of the invention.
Figure 5:
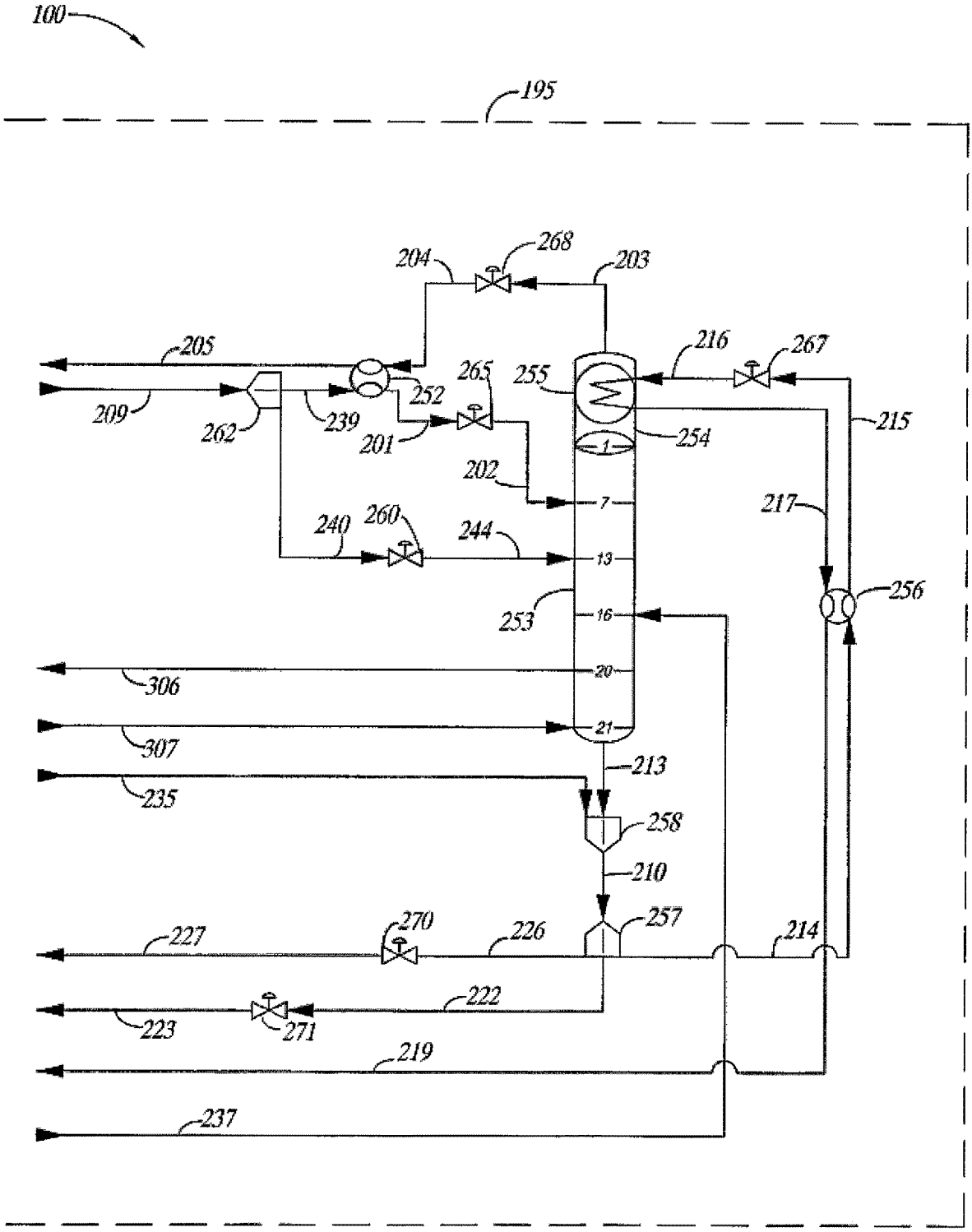
FIG. 5 is a process flow diagram illustrating principal processing stages for another part of a nitrogen removal processing section according to a preferred embodiment of the invention.

Referring to FIGS. 2-5, system 100 according to another preferred embodiment of the invention is depicted. System 100 preferably comprises an NGL Section 190 (FIGS. 2-3) and NRU Processing Section 195 (FIGS. 4-5). NGL Processing Section 190 preferably comprises a separator (Cold Separator Vessel 157), a rectifier tower (High Pressure Rectifier Tower 162 or a first fractionating column), and a second fractionating column (NGL Stabilizer Tower 165). NRU Processing Section 195 preferably comprises a first heat exchanger 250, a second heat exchanger 251, and a third fractionating column (Nitrogen Fractionation Tower 253). System 100 is capable of processing up to 300 Million Standard Cubic Feet per Day (MMSCFD) of feed gas containing up to 80% $N_2$ to produce a sales gas stream that meets pipeline specifications on $N_2$ concentration and to recover at least 90% of the ethane, and more preferably at least 95% of the ethane, from the feed stream in the NGL product stream.

Feed stream 180 comprises natural gas that has already been processed according to known methods to remove excessive amounts of $H_2S$, $CO_2$, and water. For the particular example described herein, feed stream 180 has the following basic parameters: (1) Pressure of near 800 PSIG; (2) Inlet temperature of near 120° F.; (3) Inlet gas flow of 100 Million Standard Cubic Feet per Day (MMSCFD); (4) Inlet nitrogen content of 10% by volume; (5) NGL content of approximately 6.5 gallons per inlet 1000 cubic feet or GPM (with 13.85% ethane, 7.85% propane, and 0.63% isobutene). The parameters of other streams described herein are exemplary based on the data for feed stream 180 used in a computer simulation. The temperatures, pressures, flow rates, and compositions of other process streams in system 100 will vary depending on the nature of the feed stream and other operational parameters, as will be understood by those of ordinary skill in the art. Feed stream 180 is directed to the Inlet Split 152 where the inlet gas is strategically split into four streams (103,105, 110, and 128) for optimum performance of both NGL Processing Section 190 and NRU Processing Section 195. These streams are ultimately recombined prior to feeding into Cold Separator Vessel 157, as described below.

Stream 103 is routed to NGL Stabilizer Bottom Reboiler 153, where heat is extracted as required to provide necessary fractionation for the downstream NGL Stabilizer Tower 165, described below. Stream 103 enters reboiler 153 at around 120° F. and is cooled to around 55° F., exiting as stream 104. NGL Stabilizer Bottom Reboiler 153 is a conventional heat exchanger external to tower 165 transferring heat between two process streams. The heat supply stream is shown as stream 103 and the heat demand stream is shown as stream 120.

Stream 110 exits the Inlet Split 152 and is routed to the NGL Stabilizer Reboiler temperature control valve 166, where it then becomes stream 111. After exiting the NGL Stabilizer Bottom Reboiler 153, stream 104 is routed to the Inlet Mixer 159, which serves as a mixing point for stream 104 and stream 111, exiting as stream 112. Inlet Mixer 159 effectively recombines two parts of feed stream 180 back into a single stream 112. Stream 110, originating from Inlet Split 152, also serves as a bypass around the NGL Stabilizer Bottom Reboiler 153 providing temperature control for the NGL Stabilizer Tower 165 by adjusting the amount of warm gas to flow into the heat exchanger 153. The outlet from Inlet Mixer 159, stream 112, is then routed to the Auxiliary Chiller 173 where the gas is cooled further. The temperature in stream 112 at around 69° F. is cooled to around −30° F. as it exits the Auxiliary Chiller 173 as stream 127. Stream 127 is then routed to the NGL Stabilizer Sidetray Reboiler 155 where stream 127 is further cooled to near −65° F. by cross exchanging with liquid from an intermediate stream from the NGL Stabilizer Tower 165. The NGL Stabilizer Sidetray Reboiler 155 is a conventional two pass shell and tube heat exchanger external to tower 165 that exchanges heat between two different process streams. The heat supply comes from stream 127 and the heat demand stream is 122. Stream 106 then exits the NGL Stabilizer Sidetray Reboiler 155 and is routed to the Cold Separator Inlet Mixer 156 where the stream is mixed with two other streams, stream 301 and stream 125, which are the two remaining parts of feed stream 180 after further processing as described below.

Stream 105 is routed from splitter 152 to the NGL Stabilizer Overhead Preheater 163 where the incoming gas from stream 105 is cooled to approximately −117° F. and exits the exchanger as stream 125. Stream 125 is then routed to the Cold Separator Inlet Mixer 156 and blends with stream 106 as described earlier. The NGL Stabilizer Overhead Preheater 163 is a conventional shell and tube heat exchanger and is designed to exchange heat between two different process streams. The heat supply stream for this heat exchanger is stream 105 and the heat demand is stream 136.

Stream 128 is routed to the Inlet Split Temperature Valve 172, which provides control of the inlet volume allowed to flow through stream 128. Stream 300 exits the Inlet Split Temperature Valve 172 and enters NRU Processing Section 195 as depicted in FIG. 4. Stream 300 enters the Warm Plate Fin Exchanger 250 where it is cooled to near −50° F. and exits the exchanger as stream 301. Stream 301 is then routed back to NGL Processing Section 190 where it is mixed with streams 125 and 106 in Cold Separator Inlet Mixer 156 to form stream 124 having a temperature and pressure of around −72° F. and 799 psia. Stream 124 feeds Cold Separator 157, where gravity separation is applied to separate the liquid from the vapor. The liquid exits the Cold Separator Vessel 157 as stream 119 and the vapor exits as stream 107.

Stream 107 is then routed to the Expander 161 where the pressure is reduced from around 797 psia to around 515 psia in exiting stream 108. This pressure reduction allows for potential heat energy to be extracted from the gas stream 107 resulting in a significant temperature reduction, as well as partial fractionation of the gas. The temperature in stream 107 at −73° F. is reduced to approximately −105° F. in stream 108 exiting expander 161. The extracted energy from the expander is represented by the dashed line labeled as 404Q, which is converted to mechanical energy to rotate the shaft connected to the compressor end of the unit shown as Compressor 150.

Stream 108 then is split in the Cryo Splitter 168 into streams 131 and 133. Stream 131 is routed to $N_2$ Fractionation Tower Reboiler 158 while stream 133 is routed around the reboiler to $N_2$ Fractionation Reboiler Temperature Valve 160. Proper temperature control is achieved by allowing a portion of stream 108 (stream 133) to bypass Reboiler 158 and flow through the temperature control valve, as temperature valve 160 regulates the heat source flow rate into the $N_2$ Fractionation Tower Reboiler 158. Nitrogen Fractionation Tower 253 (shown on FIG. 5) is used for fractionating liquid methane from nitrogen vapor. As with most fractionators, there is a requirement for a heat source to be added to the lower part of the fractionation tower and a method to extract heat from the upper portion of the same tower. The $N_2$ Fractionation Tower Reboiler 158 as shown on FIG. 3 is the heat exchange equipment designed to add heat to the Nitrogen Fractionation Tower 253. The heat source medium for this tower to operate correctly comes from stream 132. The $N_2$ Fractionation Tower Reboiler 158 is a conventional shell and tube style heat exchanger external to tower 253 designed to transfer heat between two process streams. Stream 131 is the heat supply stream (being cooled from around −105° F. to around −154° F. as stream 132) and stream 306 is the heat demand stream. Stream 132 feeds the top tray of High Pressure Rectifier Tower 162, where it provides part of the cooling required for the high pressure rectifier fractionation. The stream exiting the $N_2$ Fractionation Reboiler Temperature Valve 160, stream 134, also feeds High Pressure Rectifier Tower 162 and is introduced into the tower at a lower tray. Stream 134 has a pressure of approximately 510 psia and a temperature of around −106° F. The High Pressure Rectifier Tower 162 is a fractionation tower without an external source of heat in the lower section but is configured with an internal reflux condenser and separator in the upper section of the tower, which are graphically depicted in FIG. 3 as the Internal Rectifier Reflux Exchanger 164 and the Internal Rectifier Reflux Separator 154 respectively. Stream 134 is fed into the lower part of the High Pressure Rectifier Tower 162 as two phase fluid with around 29% liquid fraction. The liquid from Tower 162 and the liquid that is condensed from the internal Rectifier Reflux Exchanger 164 exits the bottom of the High Pressure Rectifier Tower 162 as stream 113.

Use of a high pressure rectifier 162 according to this preferred embodiment of the invention is not known in the prior art and provides an advantage because it allows for high pressure separation of the desirable heavy hydrocarbons (NGL) in raw liquid state in rectifier 162, so that further fractionation to a final specification grade NGL product (stream 130) may be produced downstream in a lower pressure fractionation tower shown as the NGL Stabilizer Tower 165. The operating pressure in the High Pressure Rectifier Tower 162 is approximately 510 psia which allows vapor from the tower overhead to be routed into the NRU Processing Section 195 without the requirement for intermediate compression. In contrast, most prior art systems would require compression between the NGL processing section and the NRU processing section to achieve pressures of around 500 psig that are needed by most prior art NRUs. The streams feeding nitrogen fractionation tower 253 according to this embodiment of the invention are around 300 psig, which is lower than the pressure typically required without sacrificing nitrogen removal efficiency. Use of the High Pressure Rectifier Tower 162 also provides a control mechanism, with the use of a reflux exchanger 164, for a desired amount of ethane to slip beyond the NGL recovery section and for routing into NRU Processing Section 195. When operating system 100 in ethane recovery mode, it is desirable to recover ethane product as liquid as possible. When operating system 100 in ethane rejection mode, the desire is to reject as much ethane from the NGL product as possible. In practice, normally ethane rejection mode will require some ethane to be recovered as liquid in order to meet other NGL product or sales gas specifications. The rectifier reflux exchanger 164 allows an operator to target the optimum ethane recovery based on the unique operating conditions of any particular system 100.

High Pressure Rectifier Tower 162 does not have an external source of heat, as is typical, but is configured with an Internal Rectifier Reflux Separator 154 and a Rectifier Reflux Exchanger 164. As gas in stream 134 enters tower 162 at a temperature of around −106° F., vapor will exit the overhead of the same tower as stream 126 with a temperature of around −149° F. This fractionation step provides a method to allow mass transfer between the components traveling up and down tower 162 as vapor to be re-condensed to liquid and exits the lower part of tower 162 where further fractionation may occur. Additional liquid mass is generated with the use of an Internal Rectifier Reflux Separator 154 and a Rectifier Reflux Exchanger 164 which allows for enhanced NGL recovery efficiency to at least 95% ethane, and preferably at least 96% ethane, and to almost 100% propane and heavier components of the amounts in feed stream 180, as compared to conventional NGL extraction units utilizing an expander (such as that disclosed in U.S. Patent Application Publication No. 2014/0013797) that recover around 85 to 94% of the available incoming ethane. One disadvantage of the conventional expander NGL extraction unit is that higher concentrations of nitrogen in the inlet gas, above 5%, reduce the recovery of NGL components, due to the negative effect that nitrogen has within the NGL fractionation tower. By using a High Pressure Rectifier system 162 according to a preferred embodiment of the invention, system 100 can process higher nitrogen concentrations in feed stream 180 without negatively impacting NGL recovery in NGL product stream 130. Nitrogen contents of around 25% to 80% in feed stream 180 can be processed by system 100 and still achieve recovery of at least 90% of the incoming ethane in feed stream 180 in NGL product stream 130. System 100 can also effectively process feed streams having lower nitrogen content, but is particularly suited for processing feed streams with a wide range of nitrogen content, from around 5% to 25% nitrogen while achieving an ethane recovery of approximately 95%.

Rectifier Reflux Exchanger 164 is preferably a vertical tube, counter flow "knock-back" style condenser exchanger constructed as part of the Internal Rectifier Reflux Separator 154, and is physically mounted inside of separator 154 at the top of tower 162. The condensation of the required reflux liquid within the High Pressure Rectifier Tower 162 is achieved without the use of reflux accumulators, reflux pumps and reflux control equipment, which would typically be required in prior art systems, thereby providing a cost savings solution with improved performance. Streams 304 and 305 supply the Liquid Natural Gas (LNG) refrigerant to Rectifier Reflux Exchanger 164. As described below, stream 304 is a portion of bottoms stream 213 from Nitrogen Fractionation Tower 253. Exiting the Rectifier Reflux Exchanger 164, stream 305 is routed to an LNG Remix 272, where it is mixed streams 243 and 309 before entering the Cold Plate Fin Exchanger 251.

Stream 126 exits the top overhead of the High Pressure Rectifier Tower 162 and is routed to the Cold Gas Splitter 175, used to split the overhead vapor from the Rectifier Reflux Exchanger 154 to route a portion (stream 136) to NGL Tower Overhead Preheater 163 and another portion (stream 310) to Nitrogen Fractionation Tower 253 shown on FIG. 5. Stream 136 exits the Cold Gas Splitter 175 and provides the refrigeration to cool the incoming gas stream 105 (which is a portion of feed stream 180) through heat exchange in NGL Tower Overhead Preheater 163. Stream 105 exits preheater 163 as stream 125, having been cooled from around 120° F. to −117° F. Stream 125 is then mixed with streams 301 and 106 to form stream 124. The primary purpose of this split is to provide control of the temperature of stream 124 feeding into Cold Separator Vessel 157, by directing a portion of overhead stream 126 to NGL Tower Overhead Preheater 163. In this example, stream 124 enters Cold Separator Vessel 157 at a temperature of around −72° F. Preferably the temperature of stream 124 will be between around −70 and −100° F., depending on the parameters of feed stream 180 and other operational parameters of system 100. Control of this temperature is important to satisfactory operation of system 100. If stream 124 is too cold, there is less duty available to reboil the NRU tower. The NRU Tower 254 will flood with liquid and will no longer separate the nitrogen resulting in off-specification residue gas with higher nitrogen content. If stream 124 is too warm, ethane recovery decreases as there will be less liquid going to the NGL Stabilizer Column 165. The NRU Tower 253 will run warmer resulting in higher methane loss through the NRU tower vent.

Stream 136 exits the NGL Tower Overhead Preheater 163 as stream 101 with a pressure of around 504 psia and a temperature of around 100° F. Stream 101 is then fed into a radial vane centrifugal compressor depicted as Expander/Compressor 150 where the pressure of this gas is increased from 504 to around 604 psia. This equipment is commonly referred to as the compressor end of an Expander/Compressor unit 161/150. Mechanical energy to drive this compressor is developed in the process by a radial vane pressure "let down" turbine commonly referred to as the expander part (expander 161) of the Expander/Compressor unit 161/150. Stream 102 is routed to an air cooled heat exchanger, Expander/Compressor Discharge Cooler 151, exiting as stream 302 having been cooled from around 133° F. to 120° F. The temperature of stream 102 is reduced in cooler 151 to within 10 degrees of maximum ambient temperature.

Stream 310, the other portion of overhead stream 126 exiting splitter 175, is routed to Cold Gas Mixer 261 and is combined with the NGL Stabilizer Tower 165 overhead stream 308 for form stream 211. Typically, there is no flow in stream 310, but some flow may be needed under certain operating conditions and during start-up, as will be understood by those of ordinary skill in the art. This combined stream 211 is then routed through to the Stabilizer Overhead Split 259 where the stream is divided into stream 237, which feeds Nitrogen Fractionation Tower 253, and stream 208, which bypasses Nitrogen Fractionation Tower 253 and is a portion of high pressure sales gas stream 231. Depending on operating parameters and the content of feed stream 180, operators of system 100 will determine whether to send the combined vapor stream 211 to Nitrogen Fractionation Tower 253 or to bypass tower 253, or what portion of stream 211 should be routed to tower 253 with the remainder bypassing tower 253 as described below.

Referring back to High Pressure Rectifier Tower 162, liquid exits the bottom of this tower as stream 113 and next enters the Stabilizer Feed Subcooler 167 where it is "subcooled" from −128° F. to a temperature below its normal boiling point and in this example to around −155° F. and exits as stream 118. This cooling is through heat exchange with stream 303. Stream 118 then enters the High Pressure Rectifier Level Valve 169 where the liquid pressure is reduced from around 505 psia to approximately 335 psia as stream 117 before feeding the NGL Stabilizer Tower 165. Stream 129 also feeds into NGL Stabilizer Tower 165. Liquid exits Cold Separator Vessel 157 as stream 119, which then feeds into Cold Separator Level Valve 170 there the pressure is reduced from around 797 psia to approximately 335 psia as stream 129, which feeds NGL Stabilizer Tower 165.

NGL Stabilizer Tower 165 is a traditional top feed cryogenic fractionator designed to maximize the amount of NGL accumulated in the bottom and minimize the loss of NGL components from the tower overhead in vapor phase. The top feed, or theoretical tray number 1, is supplied from stream 117 (the bottoms of High Pressure Rectifier Tower 162, as previously described), and a side feed stream, or theoretical tray number 10, is supplied from stream 129 (the bottoms of Cold Separator Vessel 157, as previously described). The feed from the Cold Separator Vessel 157 to the NGL Stabilizer Tower 165 occurs at the midpoint of the trayed sections of tower 165.

Heat to reboil this fractionation tower 165 comes from three sources. The first source of heat comes from NGL Stabilizer Bottom Reboiler 153 which uses inlet gas stream 103 as the heating medium. The second source of heat comes from the NGL Stabilizer Reboiler Trim 174, as stream 121 exits the NGL Stabilizer Bottom Reboiler 153 and is also routed through the NGL Stabilizer Reboiler Trim 174 to feed the NGL Stabilizer Tower 165 as stream 135. The combined heat from source one and source two provide the heat demand for the NGL Stabilizer Tower 165 bottom reboiler requirement. The third source of heat comes from the NGL Stabilizer Sidetray Reboiler 155 which also uses the inlet gas stream 127 (originating from streams 103 and 110) as a heat supply source but downstream of Auxiliary Chiller 173. Stream 122 is drawn from the NGL Stabilizer Tower 165 to the NGL Stabilizer Sidetray Reboiler 155 where the stream absorbs heat and is returned to the stabilizer tower as stream 123. The NGL Stabilizer Sidetray Reboiler 155 operates at a significantly lower temperature than the NGL Stabilizer Bottom Reboiler 153 providing for a more optimum input temperature profile for the NGL Stabilizer Tower 165 total heat demand.

Stream 308 exits NGL Stabilizer Tower 165 as the overhead stream, which is directed to NRU Processing Section 195 for further processing in Nitrogen Fractionation Tower 253 or to bypass tower 253 as a sales gas stream, depending on operating parameters. Stream 130 exits NGL Stabilizer Tower 165 as the bottoms stream, which is the NGL product stream. Stream 130 comprises negligible nitrogen, around 0.82% methane, around 55.2% ethane, around 32.5% propane, and around 2.6% isobutene. This represents around 96% ethane recovery from the ethane in feed stream 180 and almost 100% recovery of the propane and heavier components from the amounts in feed stream 180.

Referring to FIGS. 4-5, a preferred embodiment of NRU Processing Section 195 is depicted. NRU Processing Section 195 preferably comprises two heat exchangers 250 and 251 and a nitrogen fractionation tower 253. Warm Plate Fin Exchanger 250 is preferably a multi-pass brazed aluminum plate fin heat exchanger designed to simultaneously transfer heat to and from several gas streams during operation of system 100, specifically, three streams to be cooled and four streams to be heated. The three streams to be cooled are streams 300, 302 and 232. The four streams to be heated are streams 220, 224, 230 and 206. A summary of the streams passing through Warm Plate Fin Exchanger 250 is as follows: (1) warm inlet stream 300 (a portion of feed stream 180) from FIG. 2 Inlet Split Temperature Valve 172 and exits as cooled stream 301 going back to the Cold Separator Inlet Mixer 156 in FIG. 2; (2) warm inlet stream 302 from Expander/Compressor Discharge Cooler 151 in FIG. 3 and exiting as cooled stream 200 going to Cold Plate Fin Exchanger 251; (3) warm inlet stream 232 from residue gas compression downstream of NRU Processing Section 195 (not shown, but similar to FIG. 7 in U.S. Application Publication No. 2012/0324946, incorporated herein by reference) and exiting as stream 233 going to the Cold Plate Fin Exchanger 251; (4) cold inlet stream 220 from the Cold Plate Fin Exchanger 251 and exiting as stream 221 going to the residue gas compression (not shown) as the low pressure product gas stream; (5) cold inlet stream 224 from the Cold Plate Fin Exchanger 251 and exiting as stream 225 going to residue gas compression (not shown) as the intermediate pressure product gas stream; (6) cold inlet stream 230 from the Cold Plate Fin Exchanger 251 and exiting as stream 231 going to the residue gas compression (not shown) as the high pressure product gas stream; and (7) cold inlet stream 206 from the Cold Plate Fin Exchanger 251 and exiting as stream 207 going to the nitrogen vent. Stream 232 is returned from the compression stage (not shown) downstream of NRU Processing Stage 195 and is the supply source for the recycle refrigerant utilized as a critical low temperature refrigerant for both NGL and nitrogen removal process units. Stream 232 is a portion of one of the methane product streams (221, 225, 235) or some combination thereof as they are mixed during successive stages of compression. Stream 207 is the rejected nitrogen (from overhead stream 203 from Nitrogen Fractionation Tower 253). Stream 207 is a pressure of 12 psia in this example, but could be at a lower pressure or compressed to a higher pressure (around 300 psig) if the nitrogen will be introduced back into an oil reservoir for secondary or tertiary oil enhancement methods or for other purposes where near pure nitrogen is required.

Cold Plate Fin Exchanger 251 is preferably a multi-pass brazed aluminum plate fin heat exchanger designed to simultaneously transfer heat to and from several gas streams during the operation of this invention. While this equipment is similar to the Warm Plate Fin Exchanger 250 previously described, there is one less stream to be processed simultaneously. This heat exchanger is designed to receive two streams to be cooled and four streams to be heated. The two streams to be cooled are streams 200 and 233. The four streams to be heated are streams 219, 238, 212, and 205. A summary of the streams passing through Cold Plate Fin Exchanger 251 is as follows: (1) warm inlet stream 200 from Warm Plate Fin Exchanger 250 and exiting as stream 209 going to the $N_2$ Feed Splitter 262; (2) warm inlet stream 233 from Warm Plate Fin Exchanger 250 and exiting as stream 234 going to Recycle Refrigerant Expansion Valve 266; (3) cold inlet stream 219 from the $2^{nd}$ JT Subcooler 256 and exiting as stream 220 going to Warm Plate Fin Exchanger 250; (4) cold inlet stream 238 from the LNG Remix 272 block, which mixes various streams as described below, and exiting as stream 224 going to the Warm Plate Fin Exchanger 250; (5) cold inlet stream 212 from the NRU Remix block 269 and exiting as stream 230 going to the Warm Plate Fin Exchanger 250; and (6) cold inlet stream 205 from the $N_2$ Fractionation Feed Subcooler 252 and exiting as stream 206 going to the Warm Plate Fin Exchanger 250. The heat exchange between the various process streams in Warm Plate Fin Exchanger 250 and Cold Plate Fin Exchanger 251 is an important aspect of the successful operation of either NGL Processing Section 190 or NRU Processing Section 195 and is especially important for the integration of the two systems into system 100.

Stream 209 exits Cold Plate Fin Exchanger 251 where it is routed to the $N_2$ Feed Splitter 262 where it is used to split stream 209 into streams 239 and 240. Stream 239 is routed to the $N_2$ Fractionation Feed Subcooler 252, exiting as stream 201 having been further cooled into a subcooled state. $N_2$ Fractionation Feed Subcooler 252 is preferably a conventional shell and tube heat exchanger designed for cryogenic service. The heat supply stream for this exchanger is stream 239 and the heat demand stream is stream 204. Stream 204 contains the extracted nitrogen (from Nitrogen Fractionation Tower 253 overhead stream 203) that has been removed from the incoming gas stream (feed stream 180) and is also the coldest stream within system 100 at around −308° F. Stream 201 is routed to Primary JT Valve 265, exiting as stream 202 having reduced the pressure to approximately 316 psia. Stream 202 feeds Nitrogen Fractionation Tower 253 near the theoretical stage 7 as a subcooled fluid at a temperature of around −302° F. The second stream of the split is stream 240 and is routed to the $N_2$ Subcooler Bypass Valve 260 where the inlet pressure is reduced from around 591 psia to around 325 psia in stream 244, which also feeds into Nitrogen Fractionation Tower 253. The purpose of the $N_2$ Feed Splitter 262 is to provide an optimum temperature profile ranging from −250 to −300 degrees Fahrenheit for feed streams into the Nitrogen Fractionation Tower 253. The benefit of providing this cold feed stream in the upper portion of the nitrogen fractionation tower is to reduce the amount of total sales gas compression Stream 234 exits Cold Plate Fin Exchanger 251 and is routed to the Recycle Refrigerant Expansion Valve 266, exiting as stream 235. Expansion valve 266 allows the subcooled LNG refrigerant stream 235 to be available to supply additional refrigerant as necessary, which is important to the operation of system 100 as a portion of stream 235 is used as refrigerant for three different demands, described below. Stream 235 is routed to an LNG Mixer 258 where it is combined with bottoms stream 213 from Nitrogen Fractionation Tower 253 to form mixed stream 210. Mixed stream 210 is then split in LNG High Pressure Splitter 257 into streams 226, 222, and 214, each of which carries a portion of LNG refrigerant stream 235, and goes on to provide refrigerant in the following components of system 100: (1) the LNG is used as a refrigerant in the High Pressure Rectifier Tower 162 shown on FIG. 3 (stream 304 passing through reflux exchanger 164); (2) the LNG is used as a refrigerant in the Stabilizer Feed Subcooler 167 also shown on FIG. 3 (stream 303 passing through subcooler 167); and (3) the LNG is used to assist in cooling a feed gas stream coming into the $N_2$ Fractionation Tower 253 as required for the separation of nitrogen and methane (cooling streams 302 and 200 in heat exchangers 250 and 251, which become streams 202 and 244 feeding tower 253).

Nitrogen Fractionation Tower 253 is preferably a specially configured fractionation tower designed to receive three different feed streams at stages 7 (stream 202, a subcooled stream), 13 (stream 244, a two-phase stream) and 16 (stream 237, a 100% vapor stream). Tower 253 is also preferably designed with an internal vertical tube reflux condenser designed to provide clean separation of methane from the extracted nitrogen. Sources of input heat come from one primary supply. This primary source of heat is added to the bottom of tower 253 at stage 21 (Stream 307) and is supplied from the $N_2$ Fractionation Tower Reboiler 158 shown on FIG. 3. The condenser is depicted as the Internal $N_2$ Reflux Exchanger 255 and the separator that physically contains the exchanger is depicted as the Internal $N_2$ Reflux Separator 254. As with the High Pressure Rectifier Tower 162, the reflux exchanger and reflux separator are assembled as one unit and is physically attached to the top of the Nitrogen Fractionation Tower 253. This allows for reflux to be added to the fractionation tower without a reflux accumulator and reflux pumps, providing additional cost savings.

Stream 213 exits the bottom of the $N_2$ Fractionation Tower 253 and is fed into the LNG Mixer 258 (mixing with stream 235) to form stream 210. Stream 210 feeds into the LNG High Pressure Splitter 257 where the one stream is separated into three streams. The first stream is 214, which is routed to the $2^{nd}$ JT Subcooler 256, exiting as stream 215. Here stream 214 is cooled from near −165° F. to −240° F. as stream 215. Stream 215 proceeds on to the Secondary JT Valve 267 where the pressure is reduced in stream 216 to approximately 21 psia creating a Joules Thomson Effect and therefore reducing the temperature to around −252° F. in stream 216 and becoming the source refrigerant for the Internal $N_2$ Reflux Exchanger 255 and exiting the exchanger as stream 217. Stream 217 proceeds to the $2^{nd}$ JT Subcooler 256 where it provides the heat demand for this heat exchanger. Stream 217 exits the $2^{nd}$ JT Subcooler as stream 219, which then passes through Cold Plate Fin Exchanger 251, exiting as stream 220. Stream 220 then passes through Warm Plate Fin Exchanger 250, exiting as stream 221 at a pressure of around 17 psia. Stream 221 is a low pressure sales gas stream that is routed to the compression stage (not shown) downstream of NRU Processing Stage 195, where it is compressed to a desired pipeline specification.

Stream 222 is the second split from the LNG High Pressure Splitter 257 and is routed to the Intermediate Pressure Control Valve 271, exiting as stream 223. This control valve 271 reduces the pressure in stream 222 from around 315 psia to around 115 psia in stream 223, which is then split in LNG LP Splitter 263 into streams 303, 304, and 242. Streams 303 and 304 are routed to NGL Processing Section 190 to provide the refrigerant required for Stabilizer Feed Subcooler 167 and Rectifier Reflux Exchanger 164 to function properly as previously described, returning to NRU Processing Section 195 as streams 309 and 305. Stream 242 passes through Rectifier Condensing Temperature Control Valve 264, exiting as stream 243. Valve 264 provides the necessary pressure drop to allow the control instrumentation to function properly for the Rectifier Reflux Exchanger 164 and the Stabilizer Feed Subcooler 167. LNG Remixer 272 provides a point where streams 305, 309, and 243 are mixed before entering the Cold Plate Fin Exchanger 251. Stream 305 is the refrigerant stream returning from the Rectifier Reflux Exchanger 164. Stream 309 is the refrigerant stream returning from the Stabilizer Feed Subcooler 167 heat exchanger. Stream 243 exits the Rectifier Condensing Temperature Valve 264 and is routed into the LNG Remixer 272. The three streams combine to make stream 238 which enters the Cold Plate Fin Exchanger 251, exiting as stream 224. Stream 238 is the primary refrigerant source to allow the nitrogen removal process to operate efficiently by cooling stream 200, which goes on to from streams 202 and 242 that feed tower 253. Stream 224 then passes through Warm Plate Fin Exchanger 250, exiting as stream 225 at a pressure of around 102 psia. Stream 225 is an intermediate pressure sales gas stream that is routed to the compression stage (not shown) downstream of NRU Processing Stage 195, where it is compressed to a desired pipeline specification.

Stream 226 is the third split from the LNG High Pressure Splitter 257 and is routed to the Nitrogen Fractionation Tower Level Control Valve 270, exiting as stream 227. This valve is important in controlling the $N_2$ Fractionation Tower 253 level and it also reduces the pressure to around 305 psia Stream 227 exits $N_2$ Fractionation Level Control Valve 270 and is routed to the LNG Remixer 272 where it joins the recycled methane stream 208 which has been subcooled to an LNG state and is made available as a combined source for the low temperature refrigerant LNG supply in heat exchangers 250 and 251 to cool streams that feed Nitrogen Fractionation Tower 253.

Stabilizer Overhead Splitter 259 allows for different operating options for system 100. The first option enables a part of the gas processed through NGL Processing Section 190 (overhead stream from NGL Stabilizer Tower 165 and a portion of the overhead stream from HP Rectifier Tower 162, as streams 308 and 310 which are combined into stream 211) to bypass the nitrogen removal step in NRU Processing Section 195 and be routed directly to sales gas recompression (after passing through heat exchangers 250 and 251) without removing the entrained nitrogen. In some cases, and depending on the inlet nitrogen content of feed stream 180, this bypass allows for a significant reduction in operational costs while allowing the desirable NGL hydrocarbons to be extracted from the total inlet stream. This option may be used if the amount of nitrogen in stream 211 is relatively low (at or below pipeline specification) and blending may be used to achieve desired nitrogen levels in the final sales gas. In practice, this bypass is preferably used when inlet gas concentrations of nitrogen are less than 10%. This bypass around the nitrogen rejection section is shown as stream 208, which is mixed in the NRU Bypass Mixer 269 with stream 227 (a portion of the bottoms stream from Nitrogen Fractionation Tower 253) to form stream 212 before entering the Cold Plate Fin Exchanger 251 and exiting as stream 230. Stream 230 then passes through Warm Plate Fin Exchanger 250, exiting as stream 231 at a pressure of around 297 psia. Stream 231 is a high pressure sales gas stream that is routed to the compression stage (not shown) downstream of NRU Processing Stage 195, where it is compressed as needed to a desired pipeline specification and may be blended with stream 221 and/or stream 225. Another option available with splitter 259 is to allow all or part of the gas from stream 211 to proceed directly into the $N_2$ Fractionation Tower 253 as feed stream 237. This stream would then be processed in the nitrogen rejection section of system 100 to remove excess nitrogen. The decision to operate with all of stream 211 feeding the nitrogen rejection section of system 100 occurs when the liquid in the bottom of the NRU tower is operating at the pipeline specification for the nitrogen content. In this scenario, the duty required to operate the reboilers is at maximum capacity. Typically, the inlet nitrogen content in feed stream 180 of around 11% or greater will be the range for sending all of stream 211 to the NRU.

The flow rates, temperatures and pressures of various flow streams referred to in connection with the discussion of the system and method of the invention in relation to FIGS. 2-5, are based on a computer simulation for System 100 having a feed gas flow rate of 100 MMSCFD containing 10% nitrogen, 65.5% methane, 13.8% ethane, 7.8% propane, and 0.63% isobutane, appear in Table 1 below. The values for energy streams referred to in connection with the discussions of the system and method of system 100 in relation to FIG. 2 appear in Table 2 below. The temperatures, pressures, flow rates, and compositions will vary depending on the nature of the feed stream and other operational parameters as will be understood by those of ordinary skill in the art.

TABLE 1

| Stream Reference Numeral | % $N_2$ | % $CH_4$ | Temperature (° F.) | Pressure (psia) | Molar Flow (lbmol/h) | Std Vapor Volumetric Flow (MMSCFD) |
|---|---|---|---|---|---|---|
| 180 | 10 | 65.5 | 120 | 800 | 22.7 | 100 |
| 101 | 22.7 | 77.1 | 100 | 504 | 18.8 | 32.8 |
| 102 | 22.7 | 77.1 | 133.6 | 604.4 | 18.8 | 32.8 |
| 103 | 10 | 65.5 | 120 | 814.7 | 22.7 | 51.9 |
| 104 | 10 | 65.5 | 55 | 809.7 | 22.7 | 51.9 |
| 105 | 10 | 65.5 | 120 | 814.7 | 22.7 | 15.6 |
| 106 | 10 | 65.5 | −65.9 | 799.7 | 22.7 | 71.8 |
| 107 | 16.1 | 77.2 | −73 | 797.2 | 19.1 | 50.7 |
| 108 | 16.2 | 77.2 | −105.5 | 515 | 19.1 | 50.7 |
| 110 | 10 | 65.5 | 120 | 814.7 | 22.7 | 19.9 |
| 111 | 10 | 65.5 | 119.7 | 809.7 | 22.7 | 1.9 |
| 112 | 10 | 65.5 | 69.2 | 809.7 | 22.7 | 71.8 |
| 113 | 4.2 | 77.2 | −128.5 | 510 | 19.6 | 17.8 |
| 117 | 4.2 | 77.2 | −155.7 | 335 | 19.6 | 17.8 |
| 118 | 4.2 | 77.2 | −155 | 505 | 19.6 | 17.8 |
| 119 | 3.6 | 53.6 | −73 | 797.2 | 26.4 | 49.3 |
| 120 | 2.4 | 64.1 | 46.3 | 326.9 | 35.9 | 40.6 |
| 121 | 2.4 | 64.1 | 58.2 | 326.9 | 35.9 | 40.6 |
| 122 | 0.0004 | 32.8 | −84.1 | 326.4 | 30.4 | 42.8 |
| 123 | 0.0004 | 32.8 | −38.5 | 326.4 | 30.4 | 42.8 |
| 124 | 10 | 65.5 | −72.8 | 799.7 | 22.7 | 100 |
| 125 | 10 | 65.5 | −117.5 | 809.7 | 22.7 | 15.7 |
| 126 | 22.7 | 77.1 | −149.1 | 509 | 18.8 | 32.9 |
| 127 | 10 | 65.5 | −30 | 804.7 | 22.7 | 71.8 |
| 128 | 10 | 65.5 | 120 | 814.7 | 22.7 | 12.5 |
| 129 | 3.6 | 53.6 | −108.6 | 335 | 26.4 | 49.3 |
| 130 | neg | 0.82 | 67 | 327 | 38.4 | 24.1 |
| 131 | 16.2 | 77.2 | −105.5 | 515 | 19.1 | 14.6 |
| 132 | 16.2 | 77.2 | −154.5 | 510 | 19.1 | 14.6 |
| 133 | 16.2 | 77.2 | −105.5 | 515 | 19.1 | 36 |
| 134 | 16.2 | 77.2 | −106 | 510 | 19.1 | 36 |
| 135 | neg | 2.4 | 67.2 | 326.9 | 35.9 | 40.6 |
| 136 | 22.7 | 77.1 | −149.1 | 509 | 18.8 | 32.8 |
| 300 | 10 | 65.5 | 119.7 | 809.7 | 22.7 | 12.5 |
| 301 | 10 | 65.5 | −50 | 804.7 | 22.7 | 12.5 |
| 302 | 22.7 | 77.1 | 120 | 584.7 | 18.8 | 32.8 |
| 303 | 0.8 | 98.4 | −200.7 | 115 | 16.3 | 2.9 |
| 304 | 0.8 | 98.4 | −200.7 | 115 | 16.3 | 8.9 |
| 305 | 0.8 | 98.4 | −150 | 110 | 16.3 | 8.9 |
| 306 | 1.2 | 98.1 | −159.5 | 315.2 | 16.3 | 78.8 |
| 307 | 1.2 | 98.1 | −158.6 | 315.2 | 16.3 | 78.8 |
| 308 | 5.9 | 92.9 | −147.3 | 325 | 16.9 | 43 |
| 309 | 0.8 | 98.4 | −150 | 110 | 16.3 | 2.9 |
| 310 | N/A | N/A | N/A | N/A | 0 | 0 |
| 200 | 22.7 | 77.1 | −50 | 594.4 | 18.8 | 32.8 |
| 201 | 22.7 | 77.1 | −304 | 586.9 | 18.8 | 4.9 |
| 202 | 22.7 | 77.1 | −302.5 | 316 | 18.8 | 4.9 |
| 203 | 99 | 1 | −247.7 | 315 | 27.9 | 9.6 |
| 204 | 99 | 1 | −308.9 | 25 | 27.9 | 9.6 |
| 205 | 99 | 1 | −203.1 | 20 | 27.9 | 9.6 |
| 206 | 99 | 1 | −65.2 | 17.5 | 27.9 | 9.6 |
| 207 | 99 | 1 | 91.2 | 12.5 | 27.9 | 9.6 |
| 208 | N/A | N/A | N/A | N/A | 0 | 0 |
| 209 | 22.7 | 77.1 | −195 | 591.9 | 18.8 | 32.8 |
| 210 | 0.8 | 98.4 | −165.9 | 315.2 | 16.3 | 86.3 |
| 211 | 5.9 | 93 | −147.3 | 325 | 16.9 | 43 |
| 212 | 0.8 | 98.4 | −166 | 305.2 | 16.3 | 23.5 |
| 213 | 0.8 | 98.4 | −158.6 | 315.2 | 16.3 | 66.3 |
| 214 | 0.8 | 98.4 | −165.9 | 315.2 | 16.3 | 41.2 |
| 215 | 0.8 | 98.4 | −240 | 312.2 | 16.3 | 41.2 |
| 216 | 0.8 | 98.4 | −252.5 | 20.7 | 16.3 | 41.2 |
| 217 | 0.8 | 98.4 | −251.3 | 19.7 | 16.3 | 41.2 |
| 219 | 0.8 | 98.4 | −205 | 19.2 | 16.3 | 41.2 |
| 220 | 0.8 | 98.4 | −65.2 | 18.2 | 16.3 | 41.2 |
| 221 | 0.8 | 98.4 | 91.2 | 17.2 | 16.3 | 41.2 |
| 222 | 0.8 | 98.4 | −165.9 | 315.2 | 16.3 | 21.6 |
| 223 | 0.8 | 98.4 | −200.7 | 115 | 16.3 | 21.6 |
| 224 | 0.8 | 98.4 | −65.2 | 107.5 | 16.3 | 21.6 |
| 225 | 0.8 | 98.4 | 91.2 | 102.5 | 16.3 | 21.6 |
| 226 | 0.8 | 98.4 | −165.9 | 315.2 | 16.3 | 23.5 |
| 227 | 0.8 | 98.4 | −165.98 | 305.2 | 16.3 | 23.5 |
| 230 | 0.8 | 98.4 | −65.2 | 302.7 | 16.3 | 23.5 |
| 231 | 0.8 | 98.4 | 91.2 | 297.7 | 16.3 | 23.5 |
| 232 | 0.8 | 98.4 | 98 | 865 | 16.3 | 20 |
| 233 | 0.8 | 98.4 | −50 | 860 | 16.3 | 20 |

TABLE 1-continued

| Stream Reference Numeral | % $N_2$ | % $CH_4$ | Temperature (° F.) | Pressure (psia) | Molar Flow (lbmol/h) | Std Vapor Volumetric Flow (MMSCFD) |
|---|---|---|---|---|---|---|
| 234 | 0.8 | 98.4 | −195 | 859.5 | 16.3 | 20 |
| 235 | 0.8 | 98.4 | −194.6 | 325 | 16.3 | 20 |
| 237 | 5.9 | 93 | −147.3 | 325 | 16.9 | 43 |
| 238 | 0.8 | 98.4 | −200.9 | 110 | 16.3 | 21.6 |
| 239 | 22.7 | 77.1 | −195 | 591.9 | 18.8 | 4.9 |
| 240 | 22.7 | 77.1 | −195 | 591.9 | 18.7 | 27.9 |
| 242 | 0.8 | 98.4 | −200.7 | 115 | 16.3 | 9.8 |
| 243 | 0.8 | 98.4 | −202.3 | 110 | 16.3 | 9.8 |
| 244 | 22.7 | 77.1 | −197.1 | 325 | 18.8 | 27.9 |

TABLE 2

| Energy Stream | Energy Rate | Power | From Block | To Block |
|---|---|---|---|---|
| 400Q | 0.423 MMBtu/h | 166.42 hp | 151 Exp/Cmp Disch Cooler | — |
| 404Q | 916562 Btu/h | 360.22 hp | 161 Expander | 150 Exp/Cmp Compressor |
| 600Q | 4.438 MMBtu/h | 1744.29 hp | Stab Trim Rebl Q | 174 NGL Stab Rebl Trim |
| 602Q | 16.127 MMBtu/h | 6338.07 Hp | 173 Aux Chiller | NGL Chiller Q |

It will be appreciated by those of ordinary skill in the art that these values are based on the particular parameters and composition of the feed stream in the above example. The values will differ depending on the parameters and composition of the feed stream 180.

A preferred method for removing nitrogen from a feed stream, such as feed stream 80 or 180 comprises the following steps: (1) separating the feed stream in a first separator into a first overhead stream and a first bottoms stream; (2) separating the first overhead stream in a first fractionating column into a second overhead stream and a second bottoms stream; (3) expanding the first overhead stream through an expander prior to feeding the first fractionating column; (4) separating the second bottoms stream in a second fractionating column into a third overhead stream and a third bottoms stream; (5) separating at least a first NRU feed stream (comprising the first portion of the second overhead stream) in a third fractionating column into a fourth overhead stream and a fourth bottoms stream; (6) cooling a first portion of the feed stream prior to the first separator and cooling a first portion of the second overhead stream prior to the third fractionating column through heat exchange with the fourth bottoms stream and a recycle refrigerant stream in a first heat exchanger; and (7) cooling the first portion of the second overhead stream after the first heat exchanger and prior to the third fractionating column through heat exchange with the fourth bottoms stream and a recycle refrigerant stream in a second heat exchanger. In this preferred embodiment, the third bottoms stream is the NGL product stream and comprises at least 90% of the ethane from the feed stream and the fourth bottoms stream is the methane product stream. Most preferably, the first fractionating column is a high pressure rectifier tower. A second NRU feed stream, comprising the third overhead stream and a second portion of the second overhead stream, may also be separated in the third fractionating column into the fourth overhead stream and fourth bottoms stream. The method also preferably comprises optionally diverting all or a portion the second NRU feed stream to bypass the third fractionating column, to save on operating costs when the nitrogen content of the second NRU feed stream allows for blending without removing nitrogen, and mixing any diverted portion of the second NRU feed stream with the methane product stream.

The method also preferably comprises one or more of the following steps: (1-a) passing a second portion of the feed stream through a first valve; (1-b) supplying heat to a bottom reboiler of the second fractionating column by cooling a third portion of the feed stream; (1-c) controlling the amount of heat supplied by the third portion of the feed stream by adjusting the first valve to alter a flow rate of the second portion of the feed stream; (2-a) mixing the second and third portions of the feed stream to form a first mixed stream after the third portion supplies heat for the second fractionating column bottom reboiler; (2-b) supplying heat to a side tray reboiler of the second fractionating column by cooling the first mixed stream; (3) cooling the first mixed stream in a first chiller prior to supplying heat to the second fractionating column side tray reboiler; (4) cooling a fourth portion of the feed stream in a third heat exchanger through heat exchange with the first portion of the second overhead stream prior to cooling the first portion of the second overhead stream in the first heat exchanger; (5) mixing the first portion of the feed stream after the first heat exchanger, the first mixed stream after heat exchange in the sidetray reboiler, and the fourth portion of the feed stream after the third heat exchanger in a first mixer and wherein these streams are mixed prior to feeding the first separator; (6) compressing the first portion of the second overhead stream after the third heat exchanger and before the first heat exchanger with a first compressor and using energy from the expanding step to drive the compressor in the compressing step (and preferably using an expander/compressor unit); (7) cooling the second bottoms stream prior to feeding the second fractionating column using a fourth heat exchanger through heat exchange with a portion of the fourth bottoms stream mixed with a portion of the recycle refrigerant stream; (8-a) mixing the fourth bottoms stream with the refrigerant recycle stream to form a second mixed stream; (8-b) splitting the second mixed stream into a first portion, a second portion, and a third portion of the second mixed stream; (8-c) splitting the second portion of second mixed stream into a fourth portion, a fifth portion, and a sixth portion of the second mixed stream; (8-d) cooling the second bottoms stream in the fourth heat exchange through heat exchange with the fourth portion of the second mixed; (9-a) decreasing the pressure of the sixth portion of the second mixed stream by passing it through a second valve; (9-b) cooling the fifth portion of the second mixed stream in an internal reflux exchanger in the first fractionating column; (10) mixing the fourth portion of the second mixed stream after passing through the fourth heat exchanger, the fifth portion of the second mixed stream after passing through the first fractionating column internal reflux heat exchanger, and the sixth portion of the second mixed stream after passing through the second valve to form a third mixed stream; (11-a) passing the first portion of the second mixed stream through the second heat exchanger and then through the first heat exchanger to form a low pressure portion of the methane product stream; (11-b) passing the third mixed stream through the second heat exchanger and then through the first heat exchanger to form an intermediate pressure portion of the methane product stream; (11-c) passing the third portion of the second mixed stream through the second heat exchanger and then through the first heat exchanger to form a high pressure portion of the methane product stream; (11-d) successively compressing, through a series of compressors downstream of the first heat exchanger, the low pressure, intermediate pressure, and high pressure portions of the methane product stream; (11-e) recycling a portion of one of the compressed portions of the methane product streams as the refrigerant recycle stream; (12-a) cooling the first part of the second mixed stream in a subcooler; (12-b) further cooling the first part of the second mixed stream in an internal reflux heat exchanger in the third fractionating column after the subcooler; (12-c) recycling the first part of the second mixed stream back through the subcooler after the internal reflux exchanger and prior to passing through the second heat exchanger; (13-a) supplying heat from a first portion of the first overhead stream to a reboiler of the third fractionating column prior to feeding the first fractionating column; (13-b) passing a second portion of the first overhead stream through a second valve; and (13-c) controlling the amount of heat supplied by the first portion of the first overhead stream by adjusting the second valve to alter a flow rate of the second portion of the first overhead stream prior to feeding the first fractionating column.

The source of feed gas streams 80 or 180 is not critical to the systems and methods of the invention; however, natural gas drilling and processing sites with flow rates of 300 MMSCFD or greater are particularly suitable. Where present, it is generally preferable for purposes of the present invention to remove as much of the water vapor and other contaminants from feed streams 80 or 180 prior to processing with systems 10 or 100. It may also be desirable to remove excess amounts of carbon dioxide from feed streams 80 and 180 prior to processing with systems 10 or 100; however, these systems are capable of processing feed streams containing approximately 100 ppm carbon dioxide without encountering the freeze-out problems associated with prior systems and methods. Methods for removing water vapor, carbon dioxide, and other contaminants are generally known to those of ordinary skill in the art and are not described herein. Most preferably, feed stream 80, 180 is delivered to system 10, 100 at a pressure of approximately 800 psig and at a temperature of near 120° F., water dry to a water level of below −300° F. dew point, $H_2S$ pretreated to a level below 4 parts per million (ppm) and $CO_2$ typically treated to a level below 100 ppm. Most of the incoming $CO_2$ will be recovered and removed in the LNG (liquid natural gas methane product stream) as it leaves the system.

The specific operating parameters described herein as based on the specific computer modeling and feed stream parameters set forth above. These parameters and the various composition, pressure, and temperature values described above will vary depending on the feed stream parameters as will be understood by those of ordinary skill in the art. Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor is legally entitled.

I claim:

1. A system for removing nitrogen from a feed stream comprising nitrogen, methane, ethane, and other components to produce a methane product stream, an NGL product stream, and a nitrogen vent stream the system comprising:

a first separator wherein the feed stream is separated into a first overhead stream and a first bottoms stream;

a first fractionating column wherein the first overhead stream is separated into a second overhead stream and a second bottoms stream;

an expander for expanding the first overhead stream prior to the first fractionating column;

a second fractionating column wherein the first bottoms stream and second bottoms stream are separated into a third overhead stream and a third bottoms stream;

a third fractionating column wherein at least a first NRU feed stream separated into a fourth overhead stream and a fourth bottoms stream;

a first heat exchanger for cooling a first portion of the feed stream prior to the first separator and cooling a first portion of the second overhead stream prior to the third fractionating column through heat exchange with the fourth bottoms stream and a recycle refrigerant stream;

a second heat exchanger for cooling the first portion of the second overhead stream after the first heat exchanger and prior to the third fractionating column through heat exchange with the fourth bottoms stream and the recycle refrigerant stream;

wherein the first NRU feed stream comprises the first portion of the second overhead stream;

wherein the third bottoms stream is the NGL product stream and comprises at least 90% of the ethane from the feed stream;

wherein the fourth overhead stream is the nitrogen vent stream; and wherein the methane product stream comprises the fourth bottoms stream.

2. The system of claim 1 further comprising a second NRU feed stream that is separated into the fourth overhead stream and fourth bottoms stream in the third fractionating column; and wherein the second NRU feed stream comprises the third overhead stream and a second portion of the second overhead stream.

3. The system of claim 2 further comprising a splitter allowing all or a portion of the second NRU feed stream to bypass the third fractionating column, with any bypassed portion of the second NRU feed stream being mixed with the methane product stream.

4. The system of claim 1 further comprising a first valve through which a second portion of the feed stream passes;

wherein the second fractionating column comprises a bottom reboiler and a side tray reboiler;

wherein the bottom reboiler is supplied with heat from a third portion of the feed stream and the amount of heat supplied is controlled with the first valve by adjusting a flow rate of the second portion of the feed stream; and wherein the first fractionating column is a high pressure rectifier tower.

5. The system of claim 4 wherein the second and third portions of the feed stream are mixed to form a first mixed stream after the third portion supplies heat for the second fractionating column bottom reboiler; and wherein the first mixed stream supplies heat for second fractionating column side tray reboiler.

6. The system of claim 5 further comprising a first chiller for cooling the first mixed stream prior to providing heat for the second fractionating column side tray reboiler.

7. The system of claim 5 further comprising a fourth portion of the feed stream and a third heat exchanger for cooling the fourth portion of the feed stream through heat exchange with the first portion of the second overhead stream prior to cooling the first portion of the second overhead stream in the first heat exchanger.

8. The system of claim 7 further comprising a first mixer for mixing the first portion of the feed stream after the first heat exchanger, the first mixed stream after heat exchange in the sidetray reboiler, and the fourth portion of the feed stream after the third heat exchanger and wherein these streams are mixed prior to feeding the first separator.

9. The system of claim 7 further comprising a first compressor to compress the first portion of the second overhead stream after the third heat exchanger and before the first heat exchanger; and wherein energy from the expander drives the compressor.

10. The system of claim 7 further comprising a fourth heat exchanger for cooling the second bottoms stream prior to feeding the second fractionating column through heat exchange with a portion of the fourth bottoms stream mixed with a portion of the recycle refrigerant stream.

11. A method for removing nitrogen from a feed stream comprising nitrogen, methane, ethane, and other components to produce a methane product stream and an NGL product stream, the method comprising:

separating the feed stream in a first separator into a first overhead stream and a first bottoms stream;

separating the first overhead stream in a first fractionating column into a second overhead stream and a second bottoms stream;

expanding the first overhead stream through an expander prior to feeding the first fractionating column;

separating the second bottoms stream in a second fractionating column into a third overhead stream and a third bottoms stream;

separating at least a first NRU feed stream in a third fractionating column into a fourth overhead stream and a fourth bottoms stream;

cooling a first portion of the feed stream prior to the first separator and cooling a first portion of the second overhead stream prior to the third fractionating column through heat exchange with the fourth bottoms stream and a recycle refrigerant stream in a first heat exchanger;

cooling the first portion of the second overhead stream after the first heat exchanger and prior to the third fractionating column through heat exchange with the fourth bottoms stream and the recycle refrigerant stream in a second heat exchanger;

wherein the first NRU feed stream comprises the first portion of the second overhead stream;

wherein the third bottoms stream is the NGL product stream and comprises at least 90% of the ethane from the feed stream;

wherein the fourth overhead stream is the nitrogen vent stream; and wherein the methane product stream comprises the fourth bottoms stream.

12. The method of claim 11 further comprising separating a second NRU feed stream in the third fractionating column into the fourth overhead stream and fourth bottoms stream; and wherein the second NRU feed stream comprises the third overhead stream and a second portion of the second overhead stream.

13. The method of claim 12 further comprising diverting all or a portion the second NRU feed stream to bypass the third fractionating column and mixing any diverted portion of the second NRU feed stream with the methane product stream.

14. The method of claim 13 wherein the first fractionating column is a high pressure rectifier tower; and the first and second NRU feed streams feed into the third fractionating column at a pressure between 265 and 350 psia.

15. The method of claim 14 wherein the first fractionating column is a high pressure rectifier tower comprising an internal reflux exchanger, the method further comprising:

controlling an amount of ethane contained in the second overhead stream by adjusting the supply of heat to the internal reflux exchanger of the first fractionating column.

16. The method of claim 11 further comprising passing a second portion of the feed stream through a first valve;

supplying heat to a bottom reboiler of the second fractionating column by cooling a third portion of the feed stream;

controlling the amount of heat supplied by the third portion of the feed stream by adjusting the first valve to alter a flow rate of the second portion of the feed stream; and wherein the first fractionating column is a high pressure rectifier tower.

17. The method of claim 16 further comprising mixing the second and third portions of the feed stream to form a first mixed stream after the third portion supplies heat for the second fractionating column bottom reboiler; and supplying heat to a side tray reboiler of the second fractionating column by cooling the first mixed stream.

18. The method of claim 17 further comprising cooling the first mixed stream in a first chiller prior to supplying heat to the second fractionating column side tray reboiler.

19. The method of claim 17 further comprising cooling a fourth portion of the feed stream in a third heat exchanger through heat exchange with the first portion of the second overhead stream prior to cooling the first portion of the second overhead stream in the first heat exchanger.

20. The method of claim 19 further comprising mixing the first portion of the feed stream after the first heat exchanger, the first mixed stream after heat exchange in the sidetray reboiler, and the fourth portion of the feed stream after the third heat exchanger in a first mixer and wherein these streams are mixed prior to feeding the first separator.

* * * * *